United States Patent [19]

Misawa et al.

[11] Patent Number: 4,845,953

[45] Date of Patent: Jul. 11, 1989

[54] REFRIGERATING SYSTEM

[75] Inventors: Hideo Misawa, Anjo; Hideo Mita, Okazaki, both of Japan

[73] Assignee: Aisin Seiki Kabushiki Kaisha, Aichi, Japan

[21] Appl. No.: 196,423

[22] Filed: May 20, 1988

[30] Foreign Application Priority Data

May 29, 1987 [JP] Japan ..... 62-136974

[51] Int. Cl.[4] ..... F25B 9/00

[52] U.S. Cl. ..... 62/6; 60/520

[58] Field of Search ..... 62/6; 60/520

[56] References Cited

U.S. PATENT DOCUMENTS 3,318,101 5/1967 Van Geuns ..... 62/6

3,372,554 3/1968 Prast et al. ..... 62/6

3,396,547 8/1968 Prast et al. ..... 62/6

FOREIGN PATENT DOCUMENTS 16158 1/1983 Japan .

*Primary Examiner*—Ronald C. Capossela

*Attorney, Agent, or Firm*—Oblon, Spivak, McClelland, Maier & Neustadt

[57] ABSTRACT

A refrigerating system of this invention includes at least one expansion chamber, at least one cryogenic accumulator, conduits connecting the expansion chamber and the cryogenic accumulator, and a substance to be cooled disposed between the expansion chamber and the cryogenic accumulator and in contact with one of conduits. It is a feature of this invention that a bypass conduit is disposed in parallel with one of the conduits in contact with the substance to be cooled. Thus, even when the substance to be cooled is placed away from one of the expansion chambers and one of the cryogenic accumulators, the refrigerating system of this invention can efficiently produce an extremely cold temperature of 40° K. or less, and cool the substance to be cooled to a much lower temperature.

4 Claims, 3 Drawing Sheets

REFRIGERATING SYSTEM

BACKGROUND OF THE INVENTION

1. Field of the Invention

This invention relates to a refrigerating system which can efficiently produce an extremely cold temperature of 40 K or less and which can be widely applied to reverse Stirling cycle refrigerators and Gifford-McMahon cycle refrigerators.

2. Discussion of the Background

Conventional refrigerating systems as shown in FIGS. 2 and 3 have been known.

As illustrated in FIG. 2, a first conventional refrigerating system comprises the following:

a first circuit including a compression chamber 201, a compression cylinder 20 and a compression piston 209 and defining the compression chamber 201, a condenser 202 connected to the compression chamber 201 and a first cryogenic accumulator 203 connected to the condenser 202;

a second circuit including a first expansion chamber 204, a second cryogenic accumulator 205 connected to the first expansion chamber 204 and the first cryogenic accumulator 203, a second expansion chamber 206, a third cryogenic accumulator 207 connected to the second expansion chamber 206 and the second cryogenic accumulator 205, a third expansion chamber 208 and an expansion piston 210 defining the first, second and third expansion chambers 204, 206 and 208;

pipings including a conduit 211 connecting the third cryogenic accumulator 207 and the third expansion chamber 208 and a heat radiating conduit 212; and a substance 213 to be cooled disposed at the intermediate portion of the conduit 211.

In this first conventional refrigerating system, a refrigerating gas in the compression chamber 201 is first compressed with the compression piston 209, and cooled with the condenser 202. After flowing through the condenser 202, the refrigerating gas is introduced into and further cooled with the first cryogenic accumulator 203. After the first cryogenic accumulator 203, the refrigerating gas is introduced into the first expansion chamber 204 and the second cryogenic accumulator 205. The refrigerating gas introduced into the second cryogenic accumulator 205 is further cooled, and introduced into the second expansion chamber 206 and the third cryogenic accumulator 207. And then, the refrigerating gas introduced into the third cryogenic accumulator 207 is further cooled, and introduced into the third expansion chamber 208. The refrigerating gas introduced into the first, second and third expansion chambers 204, 206 and 208 expands as the expansion piston 210 retracts, thereby producing refrigeration of approximately 90 K, 60 K and 40 K respectively in the first, second and third expansion chambers 204, 206 and 208. Thus, the substance 213 is cooled with the refrigeration of approximately 40 K produced in the third expansion chamber 208 and conducted through the conduit 211 by way of the heat radiating conduit 212 disposed between the third cryogenic accumulator 207 and the third expansion chamber 208.

As illustrated in FIG. 3, a second conventional refrigerating system has basically same arrangement as that of the first conventional refrigerating system other than the following: this conventional refrigerating system includes a conduit 303 connecting a third expansion chamber 301 and a third cryogenic accumulator 302, and a good heat conductor 305 such as copper disposed between the conduit 303 and a substance 304 to be cooled. The substance 304 to be cooled is brought into contact with the good heat conductor 305, and is cooled by way of the good heat conductor 305.

In the first conventional refrigerating system illustrated in FIG. 2, if it is desired to place the substance 213 to be cooled away from the third expanion chamber 208 and the third cryogenic accumulator 207, the conduit 211 should be made longer. Accordingly, the conduit resistance is increased to adversely affect the flow of the refrigerating gas and the third expansion chamber 208 of this refrigerating system does not produce a desired refrigerating temperature.

In the second conventional refrigerating system illustrated in FIG. 3, if it is desired to place the substance 304 to be cooled away from the conduit 303, there arises a temperature difference between the end surface of the good heat conductor 305 in contact with the conduit 303 and the end surface thereof in contact with the substance 304 to be cooled. Consequently, the substance 304 to be cooled is not cooled to a desired refrigerating temperature even when this refrigerating system works to its refrigerating capacity. SUMMARY OF THE INVENTION This invention is for solving the drawbacks mentioned above. It is an object of this invention to provide a refrigerating system producing efficiently an extremely cold temperature of 40 K or less when a substance to be cooled is placed greatly away from the refrigerating system.

A refrigerating system of this invention comprises at least one expansion chamber, at least one cryogenic accumulator, conduits connecting the expansion chamber and the cryogenic accumulator, and a substance to be cooled disposed between the expansion chamber and the cryogenic accumulator and in contact with one of conduits. In addition, the refrigerating system of this invention has a bypass conduit disposed in parallel with one of the conduits which contacts with the substance to be cooled. To be concrete, it is a feature of this invention that, in addition to a conduit for taking out an extremely cold temperature connecting a third expansion chamber and a third cryogenic accumulator, it has a bypass conduit connecting the third expansion chamber and the third cryogenic cold accumulator disposed in parallel with the conduit for taking out an extremely cold temperature connecting the third expansion chamber and the third cryogenic accumulator.

In operation, the amount of a refrigerating gas flowing in the bypass conduit is varied by varying an inside diameter of the bypass conduit connecting the third expansion chamber and the third cryogenic accumulator. Since some of the refrigerating gas flows in the bypass conduit, resistance against flowing gas of the conduit for taking out an extremely cold temperature connecting the third expansion chamber and the third cryogenic accumulator decreases. Thus, the substance to be cooled is cooled with an extremely cold temperature efficiently, since the refrigerating gas flows well so that the refrigerating system produces a further lowered refrigerating temperature and the temperature difference between the refrigerating system and the substance to be cooled is minimized.

In short, this invention is a refrigerator using the reverse Stirling cycle or the Gifford-McMahon cycle in which a bypass conduit is disposed in parallel with a conduit for cooling a substance to be cooled connecting one of the expansion chambers and one of the cryogenic accumulators.

This invention can vary the amount of refrigerating gas flowing in the conduits connecting one of the expansion chambers and one of the cryogenic accumulators to flow the refrigerating gas well in the conduits by varying the inside diameter of the bypass conduit which short-circuits the conduits. Thus, even when the substance to be cooled is placed away from the expansion chamber and the cryogenic accumulator, the refrigerator using this invention can efficiently produce an extremely cold temperature of 40 K or less, and cool the substance to be cooled to a much lower temperature.

DETAILED DESCRIPTION OF THE PREFERRED EMBODIMENT

Figure 1:
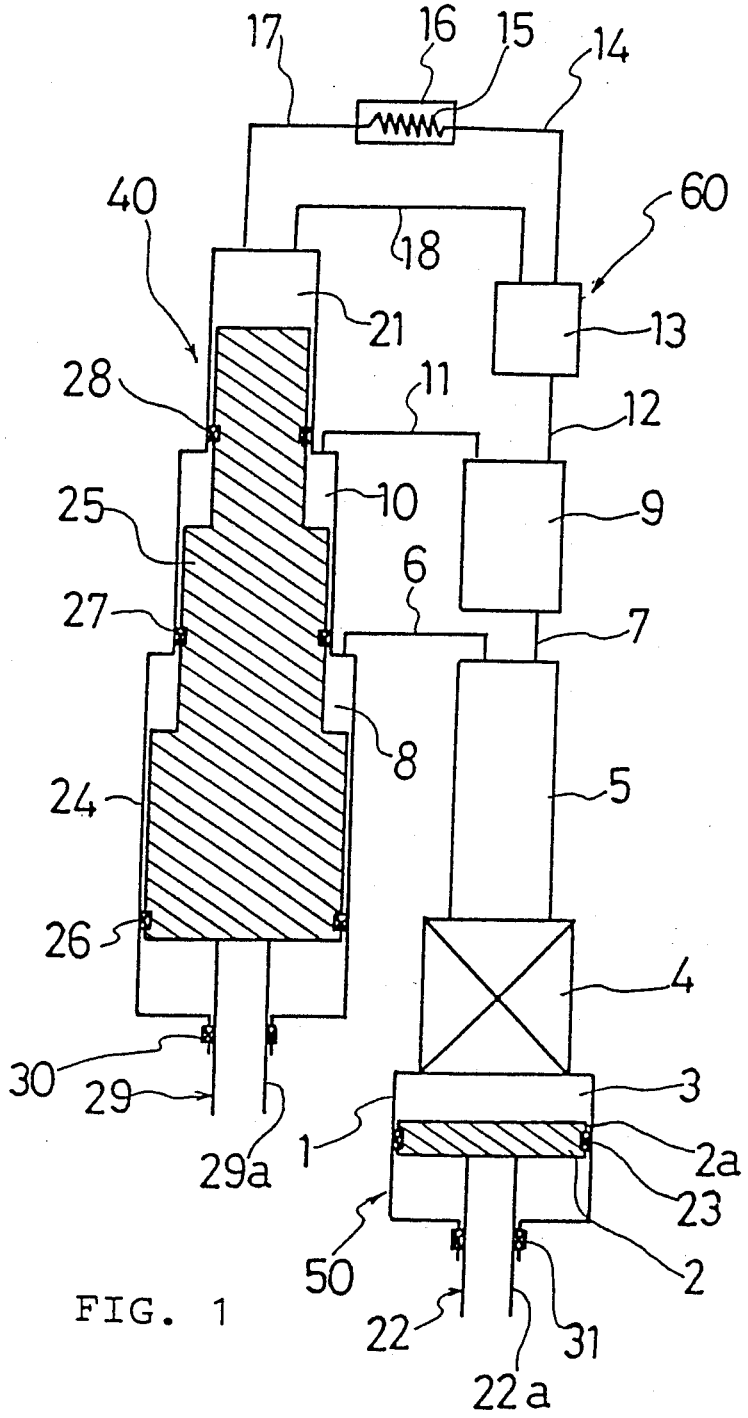
FIG. 1 is a diagram of an arrangement of a preferred embodiment of this invention.
Figure 2:
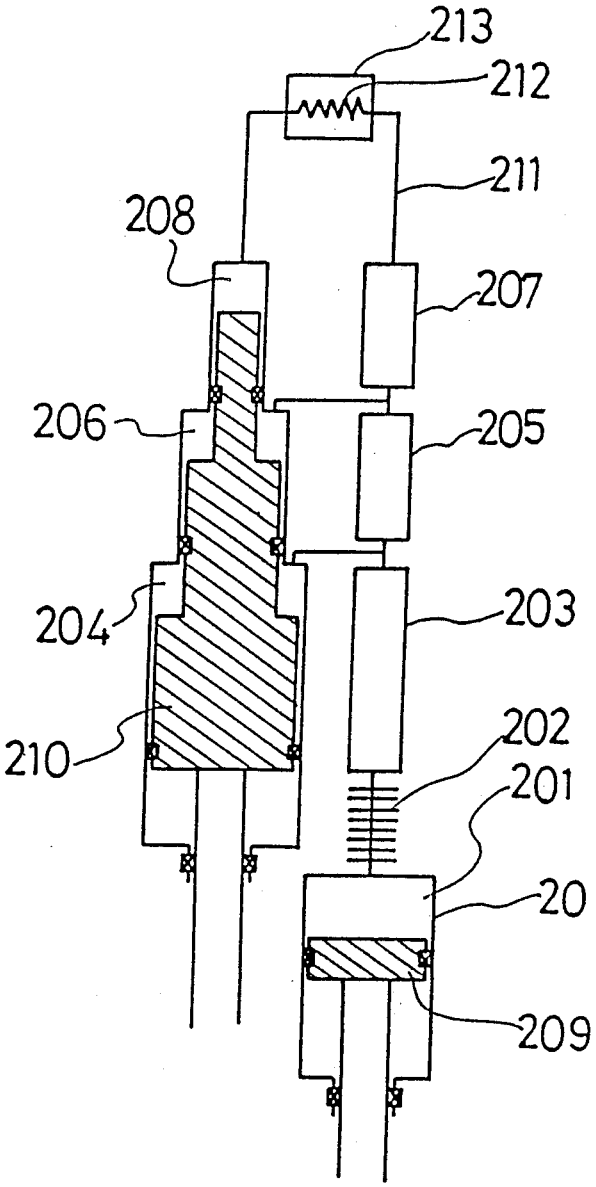
FIG. 2 (PRIOR ART)
FIG. 2 is a diagram of an arrangement of the first conventional refrigerating system.
Figure 3:
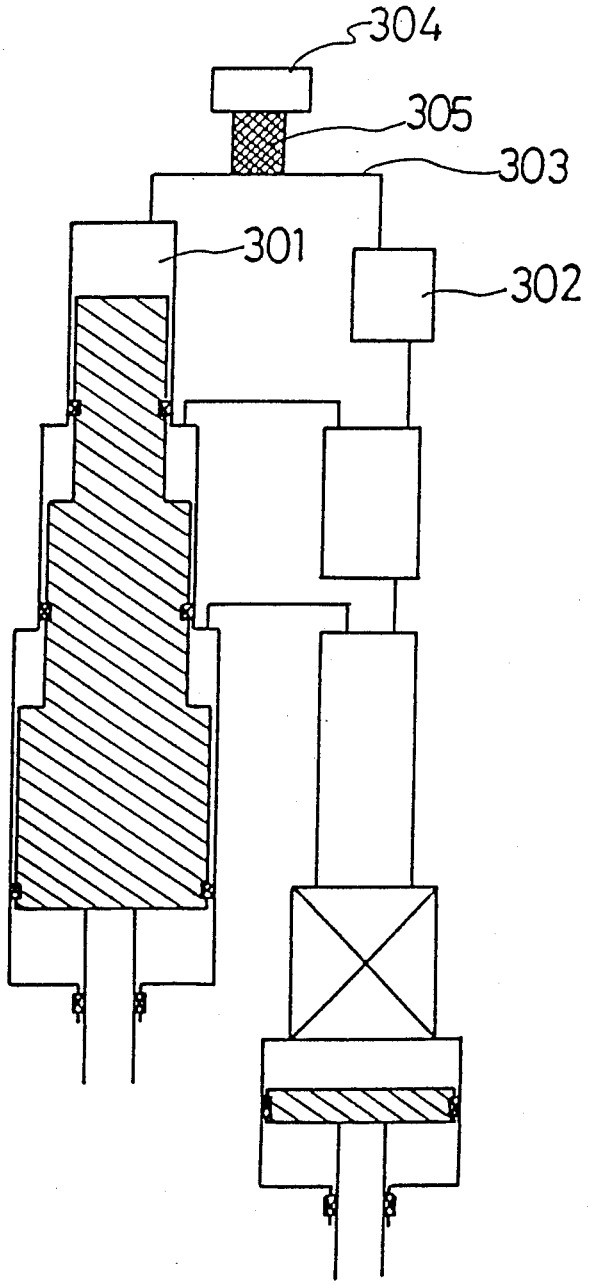
FIG. 3 (PRIOR ART)
FIG. 3 is a diagram of an arrangement of the second conventional refrigerating system.

A refrigerating system of a preferred embodiment of this invention will be hereinafter described with reference to FIG. 1.

The refrigerating system of this preferred embodiment basically comprises the following:

expansion chamber means 40 including, a first expansion chamber 8, a second expansion chamber 10, a third expansion chamber 21, an expansion cylinder 24 and an expansion piston 25;

a cryogenic accumulating chamber means 60 comprising a compression chamber 50 including a compression cylinder 1 defining the compression chamber, a compression piston 2 dividing the compression chamber into two portions 3, 50, a condenser 4, a first cryogenic accumulator 5, a second cryogenic accumulator 9, and a third cryogenic accumulator 13;

a substance 16 to be cooled connected to a conduit 14 and a conduit 17 and disposed between the expansion space 40 and the cryogenic accumulating chamber 60; and a bypass conduit 18 disposed in parallel with the conduit 14 and the conduit 17.

The arrangement will be hereinafter described further in detail. The compression chamber 3 defined in the compression chamber 50 is communicated with the condenser 4 and the first cryogenic accumulator 5, and connected to the first expansion chamber 8 and one end of the second cryogenic accumulator 9 with a conduit 6 and a conduit 7 respectively. The other end of the second cryogenic accumulator 9 is connected to the second expansion chamber 10 and one end of the third cryogenic accumulator 13 with a conduit 11 and a conduit 12 respectively. The other end of the third cryogenic accumulator 13 is connected to the third expansion chamber 21 with a conduit 14, a heat radiating conduit 15 within the substance 16 to be cooled and a conduit 17, and is further connected to the third expansion chamber 21 with a bypass conduit 18 disposed in parallel with the conduit 14, the heat radiating conduit 15 and the conduit 17. An inside diameter of the bypass conduit 18 is set less than inside diameters of the conduits 14 and 17, and the refrigerating system thus arranged is filled with a refrigerating gas such as a helium gas.

Further, a rod 22 is joined to the compression piston 2, and a piston ring 23 is provided to the outer rim 2*a* of the compression piston 2 to seal off the refrigerating gas, and a seal 31 is also provided in contact with the outer wall of the rod 22 for the same purpose.

The first, second and third expansion chambers 8, 10 and 21 are defined with the two-stepped expansion cylinder 24 and the two-stepped expansion piston 25. The outer rim of each step of the expansion piston 25 is provided with piston rings 26, 27 and 28 to seal off the refrigerating gas. Further, a rod 29 is joined to the expansion piston 25, and a seal 30 is also provided in contact with the outer wall 29*a* of the rod 29 for the same purpose. The rod 22 and the rod 29 is so joined to a reciprocating mechanism (not shown), such as a crank mechanism, that the expansion piston 25 runs ahead of the compression piston by a phase of approximately 90 deg.

Although the bypass conduit is disposed to connect the third cryogenic accumulator 13 and the third expansion chamber 21 in this preferred embodiment, it may be disposed to connect the first cryogenic accumulator 5 and the first expansion chamber 8 or the second cryogenic accumulator 9 and the second expansion chamber 10 depending on a substance to be cooled.

The operation of thus arranged refrigerating system of a preferred embodiment of this invention will be hereinafter described. The refrigerating gas such as a helium gas is compressed with the compression piston 2, and cooled in the condenser 4. The refrigerating gas then flows through the first cryogenic accumulator 5, and further cooled in it. After the refrigerating gas passes through the first cryogenic accumulator 5, it flows into the first expansion chamber 8 and the second cryogenic accumulator 9 through conduits 6 and 7 respectively. Some of the refrigerating gas flowing into the first expansion chamber 8 is expanded when the expansion piston 25 retracts, and an approximately 90 K of refrigeration is produced. Then, some of the refrigerating gas flowing into the second cryogenic accumulator 9 is further cooled in it, and it flows into the second expansion chamber 10 and the third cryogenic accumulator 13 through the conduits 11 and 12 respectively. And then, some of the refrigerating gas flowing into the second expansion chamber 10 is expanded when the expansion piston 25 retracts, and an approximately 60 K of refrigeration is produced. Further, some of the refrigerating gas flowing into the third cryogenic accumulator 13 is further cooled in it, and flows in two directions; i.e. through the conduit 14 and the bypass conduit 18. Some of the refrigerating gas flowing through the conduit 18 is introduced into the third expansion chamber 21 through the bypass conduit 18, and some of the refrigerating gas flowing through the conduit 14 is introduced into the third expansion chamber 21 after passing through the heat radiating conduit 15 and the conduit 17. The refrigerating gas flowing into the third expansion chamber 21 is expanded when the expansion piston 25 retracts, and an approximately 40 K of refrigeration is produced.

The third expansion chamber 21 and the third cryogenic accumulator 13 are connected with the conduit 14, the heat radiating conduit 15, the conduit 17 and the bypass conduit 18 as described above. Since the bypass conduit 18 connects the third expansion chamber 21 and the third cryogenic accumulator 13, the pressure loss in the conduits 14, the heat radiating conduit 15 and the conduit 17 can be decreased even when the pressure loss is increased by setting the lengths of the conduit 14, the heat radiating conduit 15 and the conduit 17 longer. Thus, the refrigerating gas flows well without hindrance, and the refrigerator of this preferred embodiment can efficiently produce an extremely low temperature.

What is claimed is:

1. A refrigerating system for producing an extremely cold temperature of 40 K or less, comprising:

at least one expansion chamber;

at least one cryogenic accumulator;

conduits in which a refrigerating gas flows alternately and bi-directionally, said conduits connecting said expansion chamber and said cryogenic accumulator;

a substance to be cooled disposed between said expansion chamber and said cryogenic accumulator and in contact with one of said conduits; and a bypass conduit in which said refrigerating gas flows alternately and bi-directionally in a direction corresponding to a direction of said refrigerating gas flowing in one of said conduits, said bypass conduit disposed in parallel with one of said conduits in contact with the substance to be cooled.

2. A refrigerating system according to claim 1, wherein an inside diameter of said bypass conduit is smaller than an inside diameter of said one of conduits in contact with said substance to be cooled.

3. A refrigerating system for producing an extremely cold temperature of 40 K or less, comprising:

expansion chamber means including, a first expansion chamber, a second expansion chamber, a third expansion chamber, an expansion cylinder and an expansion piston;

cryogenic accumulating chamber means comprising, a compression chamber including a compression cylinder defining said compression chamber, a compression piston dividing said compression chamber into two portions, a condenser, a first cryogenic accumulator, a second cryogenic accumulator, and a third cryogenic accumulator;

a substance to be cooled connected to a first conduit, a second conduit and a heat radiating conduit in which a refrigerating gas flows alternately and bi-directionally, said first, second and heat radiating conduits connecting said third expansion chamber and said third cryogenic accumulator and being disposed between said third expansion chamber and said third cryogenic accumulator; and a bypass conduit in which said refrigerating gas flows alternately and bi-directionally in a direction corresponding to a direction of said refrigerating gas flowing in said first conduit, said second conduit and said heat radiating conduit, said bypass conduit disposed in parallel with said first, second and heat radiating conduits.

4. A refrigerating system according to claim 3, wherein an inside diameter of said bypass conduit is smaller than inside diameters of said first, second and heat radiating conduits.

* * * * *